US006883772B2

(12) United States Patent
Takagi et al.

(10) Patent No.: US 6,883,772 B2
(45) Date of Patent: Apr. 26, 2005

(54) EXTENSIONS FOR APERTURES IN PANELS

(75) Inventors: Kyozaburo Takagi, Centerville, OH (US); Gordon Dodson, Lewis Center, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 72 days.

(21) Appl. No.: 10/454,380

(22) Filed: Jun. 4, 2003

(65) Prior Publication Data

US 2004/0046100 A1 Mar. 11, 2004

(51) Int. Cl.[7] ..... E04G 11/00
(52) U.S. Cl. ..... 249/139; 249/35; 249/189
(58) Field of Search ..... 264/31, 154, 333; 249/35, 139, 189, 205; 52/127.3, 742.1, 745.2

(56) References Cited

U.S. PATENT DOCUMENTS 4,659,057 A * 4/1987 Felter ..... 249/97
6,182,416 B1 * 2/2001 Brackin ..... 52/745.09
6,279,868 B1 8/2001 Eyring et al.
6,322,045 B1 * 11/2001 Andros ..... 249/188
6,398,180 B1 6/2002 Eyring et al.
6,540,201 B1 * 4/2003 Gagnon et al. ..... 249/139
2003/0115816 A1 * 6/2003 Dodson et al. ..... 52/381

* cited by examiner

*Primary Examiner*—James P. Mackey
*Assistant Examiner*—Donald Heckenberg
(74) *Attorney, Agent, or Firm*—Dinsmore & Shohl LLP

(57) ABSTRACT

A panel-forming system including a plurality of bulkheads and one or more extensions. A first group of the bulkheads are used to define the overall dimensions and shape of the panel, while a second group are used to define at least one aperture formed into the panel. The aperture extensions are configured to allow various-shaped recesses to be formed in the panels adjacent the apertures, and are made up of a bulkhead-engaging portion and a separate recess portion that extends from and cooperates with the bulkhead-engaging portion. The surfaces of each bulkhead-engaging portion include a plurality of chamfers to create complementary surfaces in the panel being formed.

20 Claims, 11 Drawing Sheets

EXTENSIONS FOR APERTURES IN PANELS

CROSS-REFERENCE TO RELATED APPLICATION

This application is related to U.S. application Ser. No. 10/327,723, filed Dec. 23, 2002.

BACKGROUND OF THE INVENTION

The present invention relates generally to supports used for creating cured pre-cast panels and related structures, and more specifically to the configuration of extensions used to create recesses at panel edges and apertures that are used to define windows, doorways and related openings in the panel.

Many residential and commercial construction methods involve the use pre-cast structures. Pre-cast panels, for example, are integral to the tilt-up construction process. In the tilt-up approach, concrete forms are arranged on a flat casting surface in the shape and dimension of the desired tilt-up panel, then filled with concrete. When the concrete cures, the panel and the form are separated and the panel is tilted up into a preferred, typically vertical, orientation, where it can be joined to structural frames or other panels. The present inventors have recognized a need for improvements in pre-cast panel forming systems and in various components of the panel forming systems. The improvements introduced by the present invention have applicability in the tilt-up construction process and in other pre-cast construction processes.

BRIEF SUMMARY OF THE INVENTION

This need is met by the present invention wherein improvements in pre-cast panel forming systems and in various components of the panel forming systems are introduced. In accordance with one aspect of the present invention, a panel-forming system is disclosed. The panel-forming system includes a plurality of bulkheads and at least one aperture extension. The bulkheads and aperture extensions are placed on a panel-forming surface. In the present context, the bulkheads and aperture extensions are placed "on" a panel-forming surface, which is meant to be broadly construed, thus encompassing situations where both direct contact between the panel-forming surface (which may be, for example, a smooth floor) and the bulkheads and aperture extensions, as well as indirect support (where, for example, a release liner may be placed over the panel-forming surface prior to arrangement of the bulkheads or aperture extensions) are contemplated. The bulkheads include a first group and a second group, where the first group is arranged into the shape of the panel to be formed, while the second group is disposed substantially within a shape formed by the first group. In the present context, the term "substantially" is utilized to represent the inherent degree of uncertainty that may be attributed to any quantitative comparison, value, measurement, or other representation. As such, it refers to an arrangement of elements or features that, while in theory would be expected to exhibit exact correspondence or behavior, may, in practice embody something slightly less than exact. The term also represents the degree by which a quantitative representation may vary from a stated reference without resulting in a change in the basic function of the subject matter at issue.

Upon formation of a panel (such as by pouring an uncured panel-forming material, for example, concrete into the dimensions bounded by the two bulkhead groups), the space that is substantially surrounded by the second group defines an aperture in the panel. The aperture extension includes a bulkhead-engaging portion configured to contact the bulkhead; and a recess portion formed separately from the bulkhead-engaging portion such that upon formation of the panel, a pattern becomes defined therein by surfaces on the aperture extension that are configured to face the panel. The bulkhead-engaging portion includes a first chamfer disposed adjacent at least one of the plurality of bulkheads and a second chamfer laterally spaced relative to the first chamfer. The recess portion is configured to support at least a portion of the bulkhead-engaging portion. Thus, in contrast to conventional panel-forming systems that merely include a chamfer designed to create a bevelled recess near a panel edge that is defined by an aspect ratio of unity or thereabouts, the device of the present invention contemplates myriad recess transition possibilities, including long, gradual recesses and multifaceted recesses, which taken alone or together provide the panel designer with numerous functional and aesthetic options.

Optionally, the first and second chamfers on the bulkhead-engaging portion are separated by a region substantially non-coplanar with either of the chamfers such that a surface in the panel formed by the bulkhead-engaging portion is multifaceted. In one form, the surface disposed between the first and second chamfers is a plateau. In a more particular form, the first and second chamfers define a succession of chamfers descending away from the bulkhead. In such a descending pattern, the thickness of the castable material in the finished panel increases as the lateral distance away from the bulkhead increases. In one configuration, the bulkhead-engaging portion further comprises a stiffening rib configured to engage the recess portion, thereby strengthening the aperture extension. In another option, the recess portion extends laterally away from the bulkhead farther than does the bulkhead-engaging portion. In addition, the recess portion may extend a substantial entirety of the distance between two bulkheads, or, in another option, may extend less than the substantial entirety of the distance between two of the plurality of bulkheads. In this way, a distal end defined in the recess portion is situated away from the bulkhead, while a proximal end is situated adjacent the bulkhead. In the configuration where the recess portion does not extend across the substantial entirety of the distance between two bulkheads, an extension cap or an intermediate, each configured to engage the distal end of the recess portion, can be included. In another option, at least one stiffening rib disposed along the recess portion in a manner similar to that of the bulkhead-engaging portion. This recess portion stiffening rib may be configured to frictionally engage a base clip. Such an arrangement could be used to assist in securely mounting the recess portion to the panel-forming surface. In one configuration, the frictional engagement between the base clip and the stiffening rib is made up of complementary prismatic members disposed on coupling surfaces of the clip and the rib. Another option is that one or both of the chamfers may comprise a seal.

In yet another option, the aperture is surrounded in its entirety by the second group such that a window is defined therebetween. In an alternate configuration of this option, the aperture is surrounded by both the first and second groups such that a door is defined therebetween. In either case, the second group is configured to define a plurality of apertures in the panel. More particularly, the plurality of apertures in the panel are substantially aligned along at least one edge with one another.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1A:
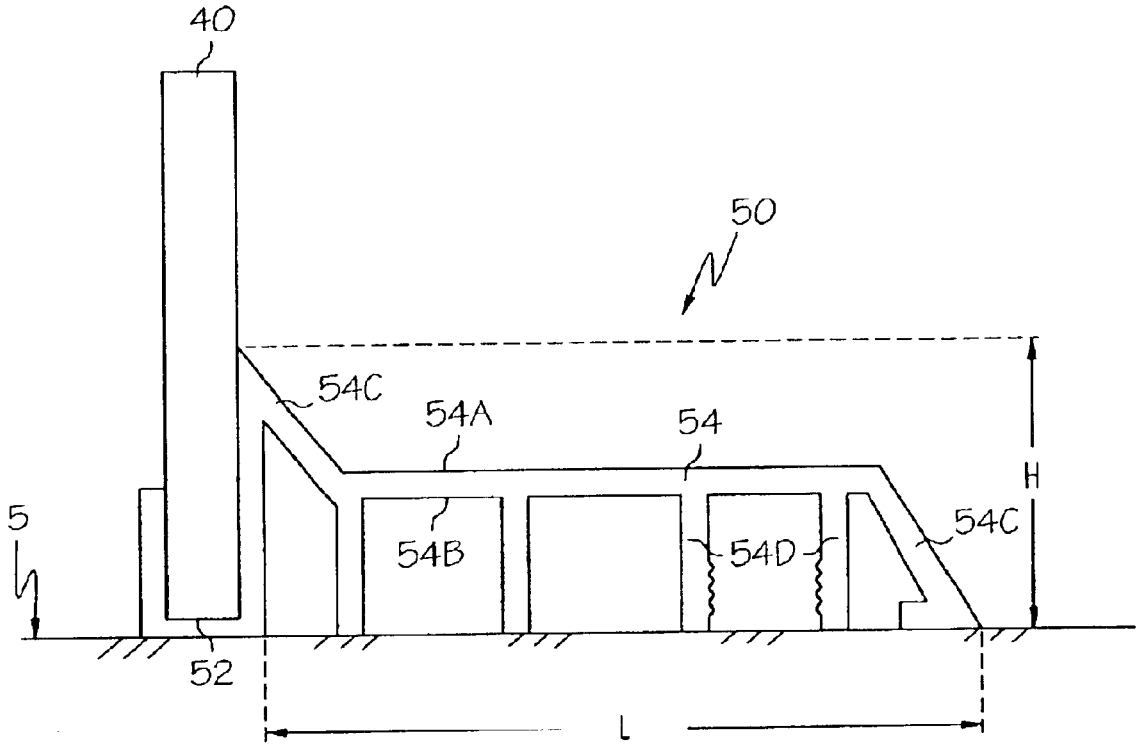
FIG. 1A is an elevation view of an embodiment of the aperture extension of the present invention engaging a bulkhead.
Figure 1B:
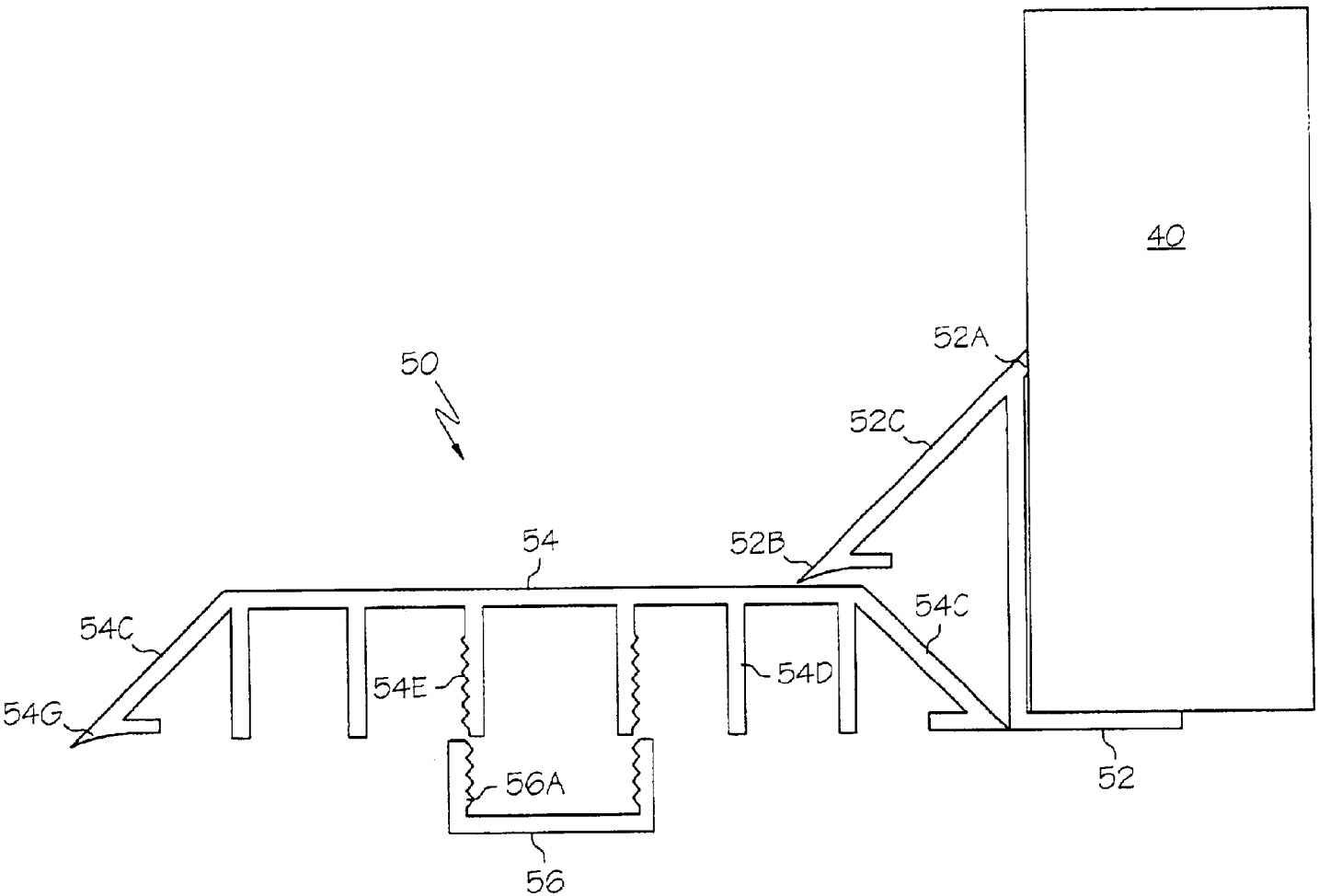
FIG. 1B is an elevation view of an alternate embodiment of the aperture extension of FIG. 1A.
Figure 6:
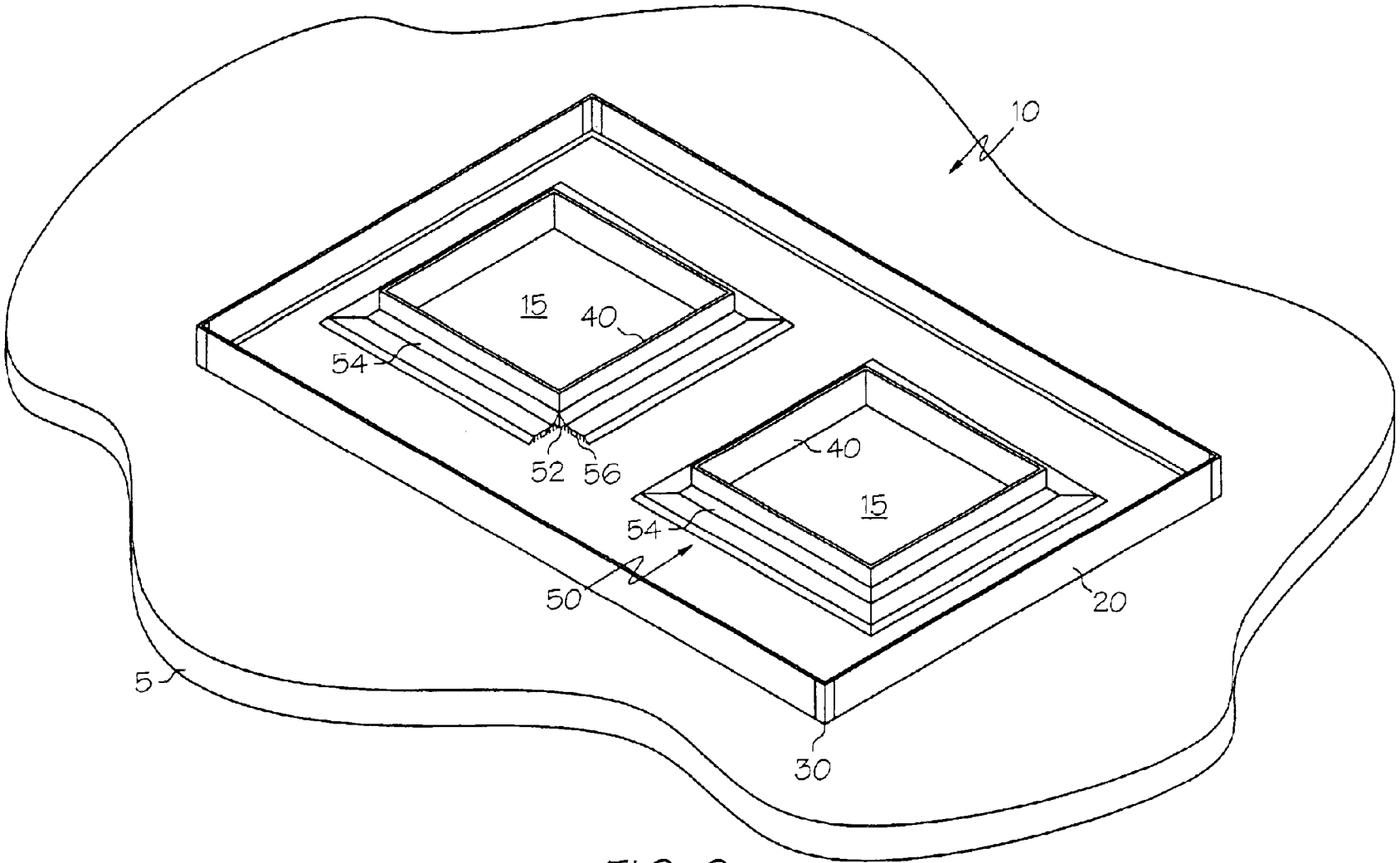
FIG. 6 shows a perspective view of a panel-forming system according to the present invention.

Referring first to FIGS. 1A, 1B and 6, a panel-forming system 10 is placed on top of a panel-forming surface 5, the latter of which is typically a smooth, generally planar surface. The panel-forming system 10 includes a plurality of bulkheads 20 (hereinafter first group bulkheads) that define the outer dimensions of the panel to be formed (not shown), a plurality of connectors 30 that can be used to secure the various first group bulkheads 20 together, and an additional plurality of bulkheads 40 (hereinafter second group bulkheads) that define the outer dimensions of one or more apertures 15 formed in the panel.

In the formation of pre-cast (or tilt-up) panels, it is advantageous to form aperture shapes into the panel prior to forming and subsequent curing of the panel-forming material (such as concrete). These apertures can be entirely enclosed within the peripheral walls of the panel (forming openings for windows or the like), or they can be formed such that one or more dimensions coincide with one or more of the peripheral walls, thus forming a door-like opening. In the former case, aperture 15 is defined entirely by the second group bulkheads 40, while in the latter by a combination of the second group bulkheads 40 (for internally-projecting portions of the aperture) and the first group bulkheads 20 for portions of the aperture that coincide with the panel periphery. In certain circumstances, it would be advantageous to provide extra definition around the periphery of aperture 15 such that the transition from aperture to panel is not so abrupt, thus providing enhanced aesthetics, as well as added resistance to cured material chipping and related breakage. In the present invention, aperture extensions 50 are employed during the panel-forming process to facilitate the formation of gradual, patterned aperture transition zones. The aperture extension 50 is defined by a relatively low aspect ratio, such that the lateral dimension L is larger than the height H. Representative lengths of the lateral dimension L range from eight to twenty inches, although the present invention is not limited to such lengths. The aperture extensions 50 may be made from numerous low-cost materials, including plastic. Moreover, the shapes defining the bulkhead-engaging portion and the recess portion can be made from low-cost manufacturing methods, such as extrusion. By using inexpensive, easy to work with materials, long sections of the aperture extensions 50 may be cut into desired length strips that can be easily assembled on the job site. Variations on aperture extension 50 are shown with particularity in FIGS. 1A and 1B, both including a bulkhead-engaging portion 52 to connect to bulkheads from the second group bulkheads 40. The bulkhead-engaging portion 52 is configured as a generally U-shaped cup into which the lower edge of the bulkhead can rest. The aperture extension 50 also includes a recess portion 54 extending laterally from the bulkhead-engaging portion 52. The recess portion 54 includes a panel-facing surface 54A and a surface 54B opposite the panel, where the shape of the former defines a pattern that gets formed into the panel when the panel-forming material is poured into the mold and subsequently cured. The recess portion 54 also includes chamfers 54C at the proximal and distal ends, such chamfers used to help define the shape of the pattern formed into the panel. As shown with particularity in FIG. 1B, a seal 54G is disposed at the terminus of the chamfer 54C. The surface 54B opposite the panel faces the panel-forming surface, and along with the rest of the space defined underneath aperture extension 50, is configured to be generally free of panel-forming material. The seal 54G forms a knife-edge that splays under the load of panel-forming material, thus inhibiting leakage of panel-forming material into the space formed under the aperture extension 50. Stiffening ribs 54D act as load-bearing structure to minimized deformation of aperture extension 50 under the weight of the panel-forming material. A series of prismatic engagement members 54E are formed in the walls of ribs 54D such that the ribs can frictionally engage complementary surfaces on a base clip 56. The base clip 56 may be formed integral with or separate from the recess portion 54, and can be secured to the panel-forming surface 5 by conventional adhesive or attachment means, including nails, screws or the like.

Referring with particularity to FIG. 1B, the bulkhead-engaging portion 52 and the recess portion 54 are formed from separate, discrete members, in contrast to the one-piece (unitary) construction of FIG. 1A. In this configuration, the base clip 56 is also separate such that the aperture extension is formed by arranging the three components to fit together. Base clip 56 is shown with frictional engaging members 56A that engage prismatic engagement members 54E of the ribs 54D of recess portion 54. In this configuration, the bulkhead-engaging portion 52 has a chamfer 52C at one end such that a portion of the pattern in the panel is formed by the bulkhead-engaging portion 52. Seals 52A and 52B form a knife-edge similar to that of aforementioned seal 54G to reduce leakage at the boundary formed between the aperture extension 50 and the bulkhead 40.

Figure 1C:
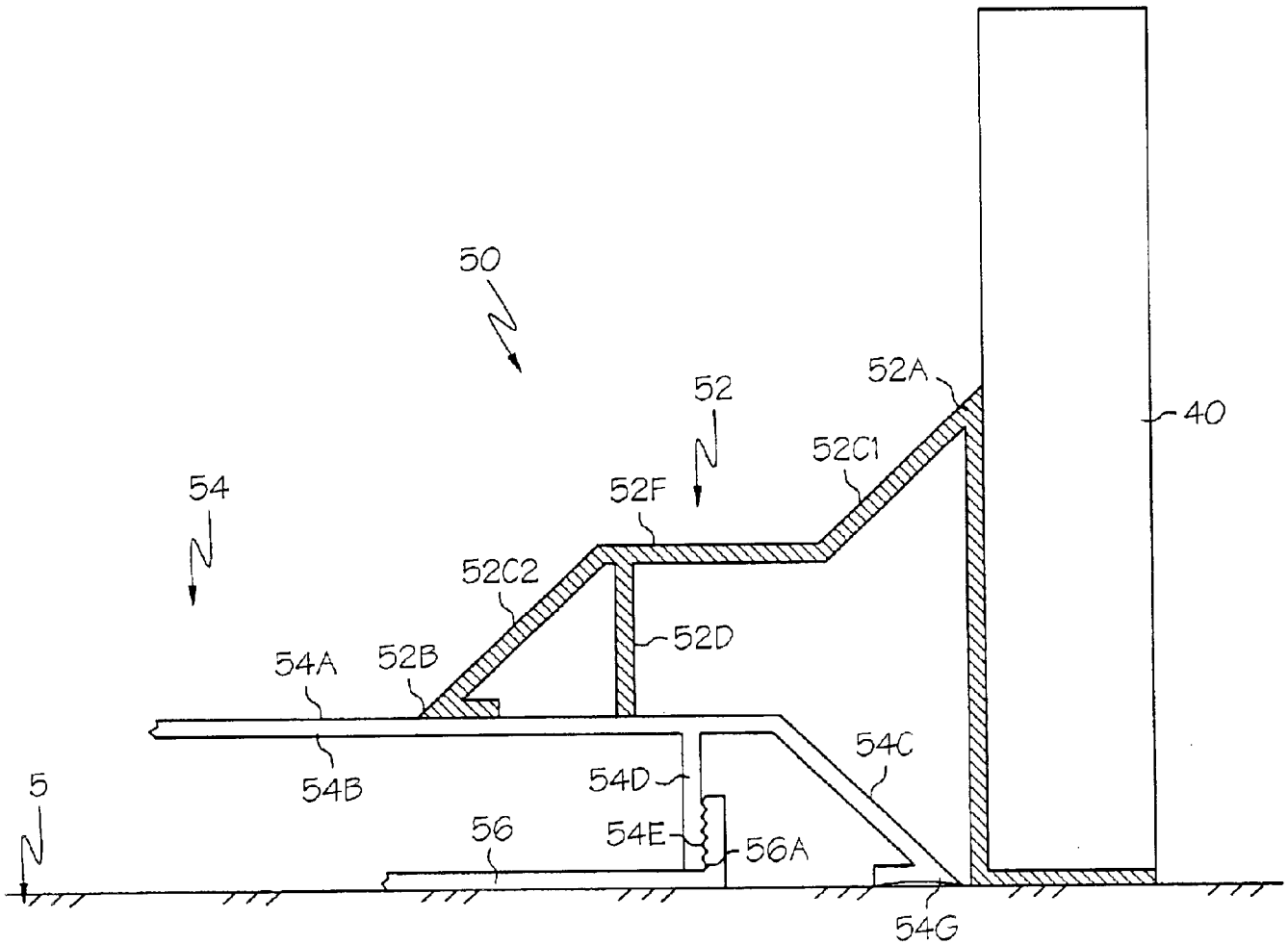
FIG. 1C is an elevation view of an alternate embodiment of the aperture extension of FIG. 1B.

Referring with particularity to FIG. 1C, as with the embodiment shown in FIG. 1B, the bulkhead-engaging portion 52 and the recess portion 54 are formed from separate, discrete members; however, in contrast to the embodiment in FIG. 1B, the bulkhead-engaging portion 52 includes a plurality of chamfers, including first chamfer 52C1 adjacent the end nearest the bulkhead 40 and a second chamfer 52C2 adjacent the end nearest the recess portion 54. These chamfers, spaced by an intermediate plateau 52F, create a double recess profile in the panel (not shown) being formed. Moreover, the first and second chamfers 52C1, 52C2 together define a succession of chamfers descending away from bulkhead 40 such that the material (for example, concrete) making up the finished panel is thicker at a lateral position farther away from the bulkhead. It will be appreciated by those skilled in the art that the present invention merely shows two chamfers for convenience, and that it is within the scope of the present invention to incorporate additional chamfers (and plateaus) into the bulkhead-engaging portion 52. The remote edges 52A, 52B of each of chamfers 52C1 and 52C2 respectively can be configured to be generally planar (as shown) or as seals, the latter shown representatively in FIG. 1B. Rib 52D extends downwardly from bulkhead-engaging portion 52 to engage a surface below, such as panel-facing surface 54A of recess portion 54, in order to provide additional stiffness to bulkhead-engaging portion 52. In addition, recess portion 54 is shown in partial, cutaway view. As such, it can terminate in a distal end similar to that of the recess portions shown in the remaining figures, including extending substantially the entire distance between bulkheads 40, in which case an additional recess is formed in the part of the panel that extends between adjacent apertures, the thickness of such recess equal to the vertical distance from the panel-forming surface 5 to the panel-facing surface 54A. As before, base clip 56 (only a portion of which is shown) with frictional engaging members 56A can engage prismatic engagement members 54E of the recess portion ribs 54D to secure recess portion 54 to the panel-forming surface 5.

Referring with particularity to FIG. 6, a panel-forming system 10 is configured for a two-aperture 15 panel. Aperture extensions 50 are placed around all four walls that define each aperture 15, thus forming a transition zone between the aperture 15 and the panel, where one corner is shown exposed to better depict the relationship between the bulkhead 40, bulkhead-engaging portion 52, recess portion 54 and base clip 56. The dimensions of the aperture extensions 50 are shown to more clearly present the details herein, and not shown to scale, as for a typical bulkhead 40, which may be four, eight, ten or twelve inches in height when placed edgewise on the panel-forming surface 5, the height of the aperture extension may be on the order of two inches or less. It will, however, be appreciated by those skilled in the art that the representative dimensions discussed herein are not to be construed as limiting, as other sizes are within the scope of the present invention.

Figure 2A:
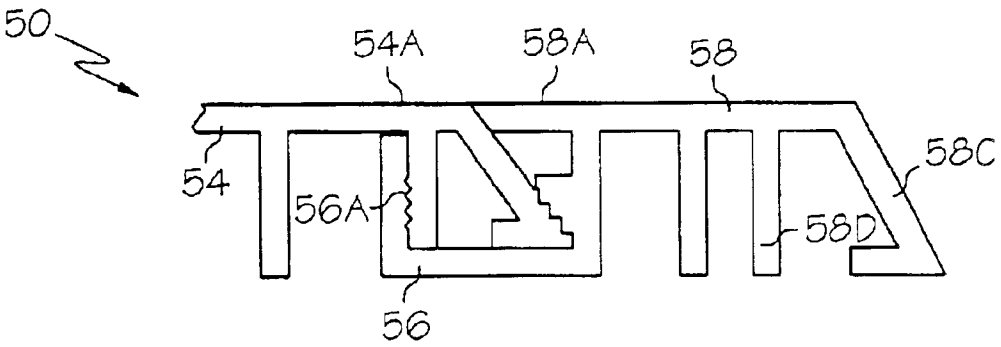
FIG. 2A is a partial view of the aperture extension of FIG. 1A, including an extension cap.
Figure 2B:
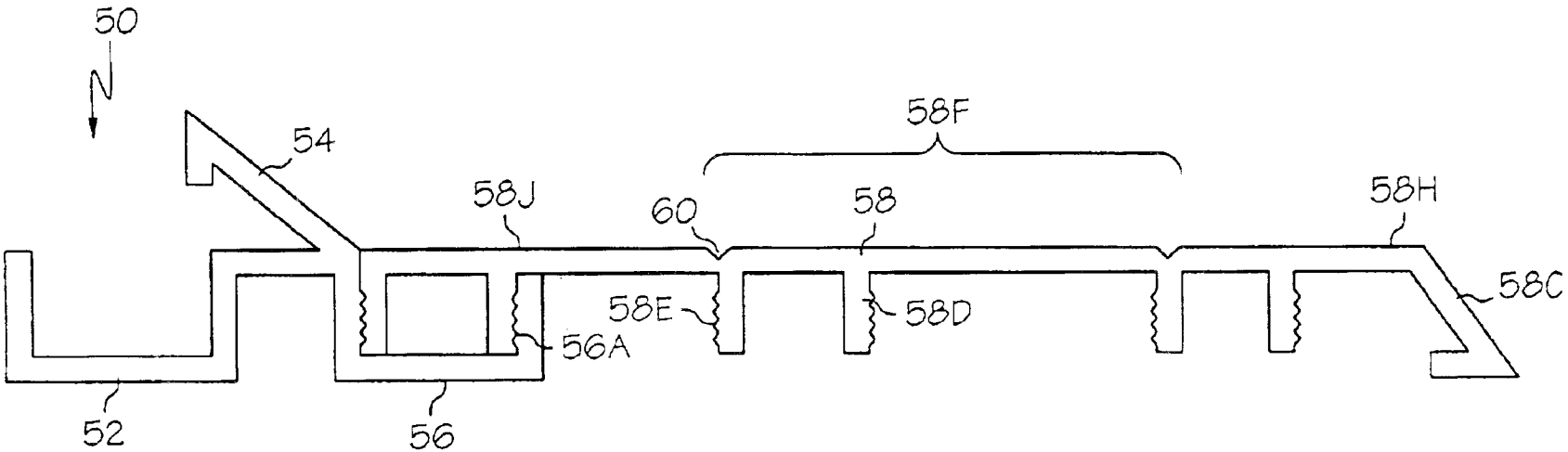
FIG. 2B is a variation of the extension cap of FIG. 2A, showing breakaway portions along one or more notches.
Figure 2C:
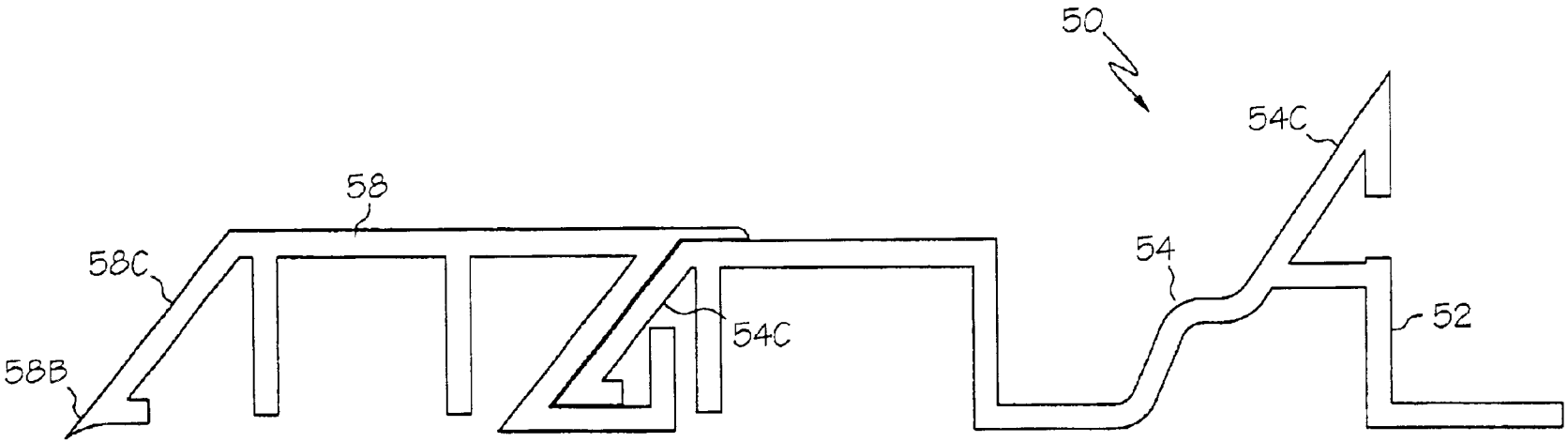
FIG. 2C is a variation of the connection between an aperture extension and an extension cap.
Figure 3A:
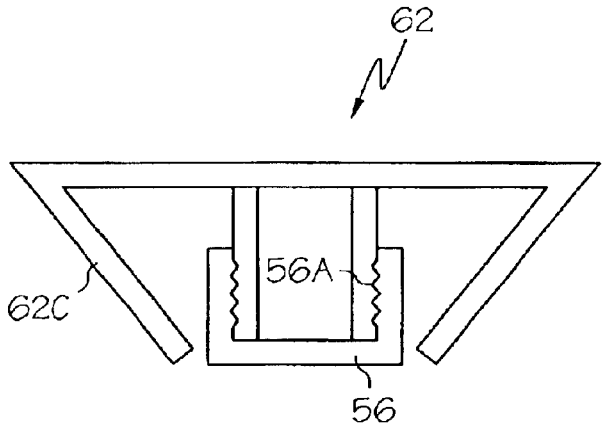
FIG. 3A shows an intermediate.
Figure 3B:
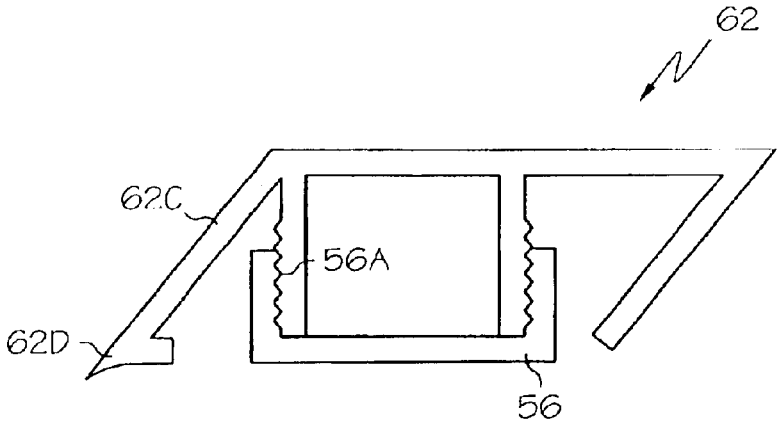
FIG. 3B shows an alternate embodiment of the intermediate.
Figure 3C:
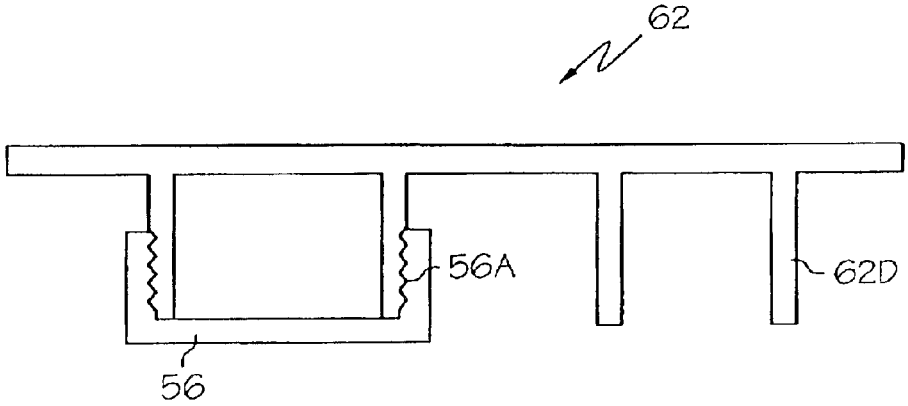
FIG. 3C shows yet an alternate embodiment of the intermediate.
Figure 4:
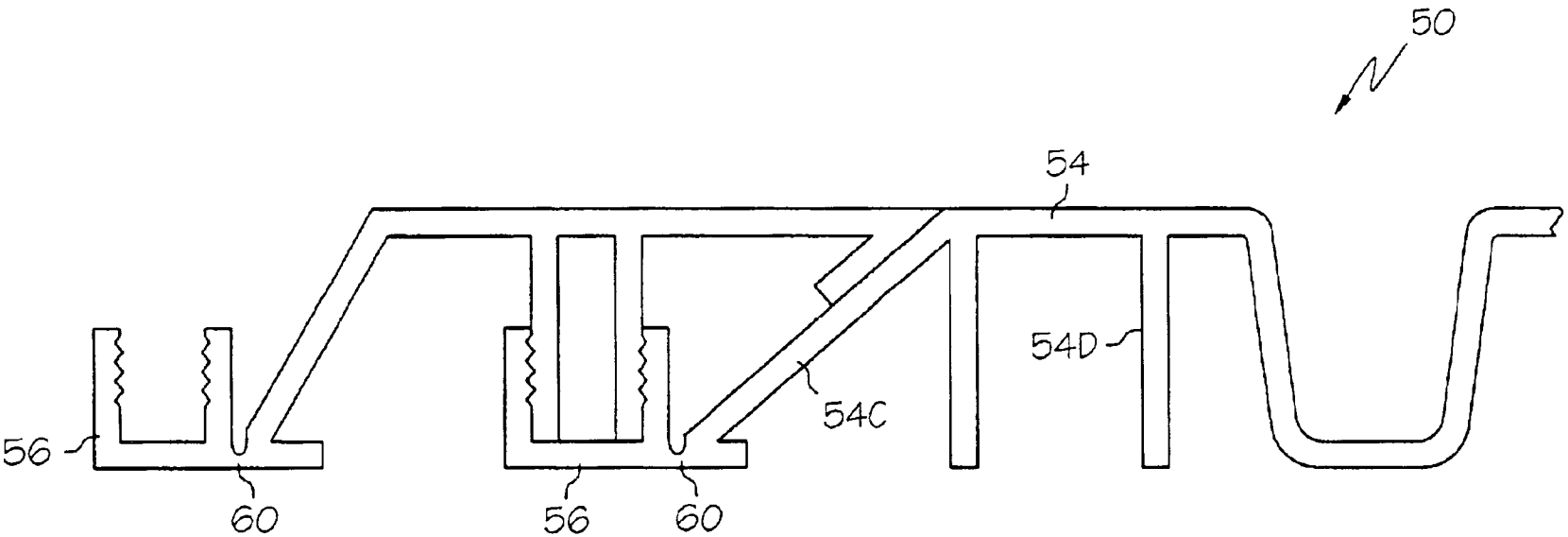
FIG. 4 shows the integration of the intermediate of FIG. 3B into an aperture extension.
Figure 5A:
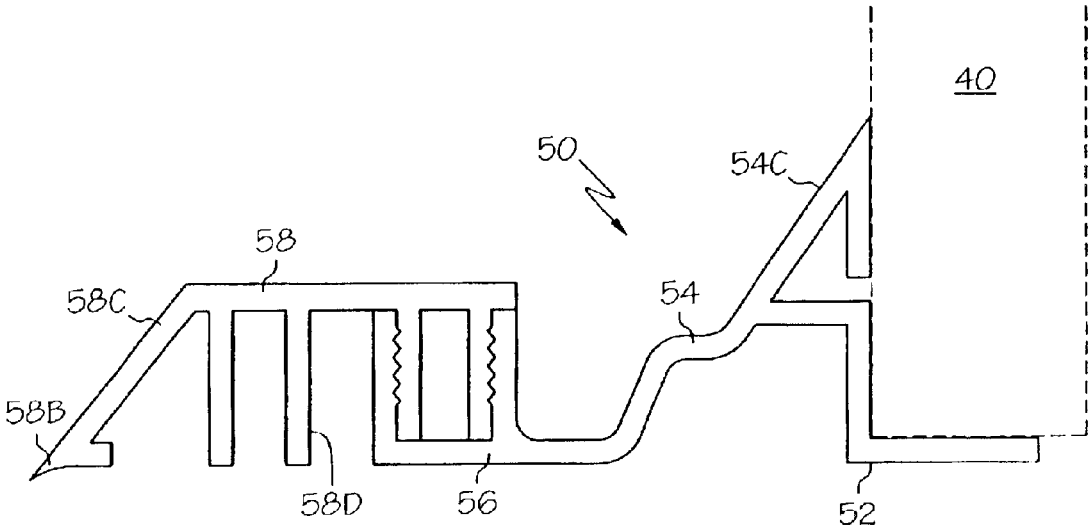
FIG. 5A shows an alternate embodiment of the aperture extension of FIG. 1A with an extension cap coupled to it, both connected by a base clip.
Figure 5B:
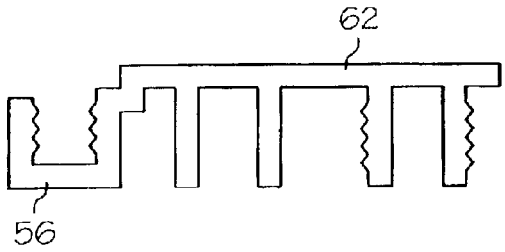
FIG. 5B shows an alternate embodiment of the intermediates of FIGS. 3A–3C.

Referring next to FIGS. 2A through 2C, 3A through 3C, 4, 5A and 5B, additional ways to extend the lateral dimension of the aperture extension 50 are disclosed. From the distal end of aperture extension 50, an extension cap 58 is added. The extension cap 58 includes an upper surface 58A, a chamfer 58C with seal 58B, stiffening ribs 58D and (as shown with particularity on the configuration depicted in FIG. 2A) an integral base clip 56 with frictional engaging members 56A. The configuration shown in FIG. 2A allows the distal end of the aperture extension 50 to lock with extension cap 58 through the base clip 56. The configuration shown in FIG. 2B achieves the same, but further includes notches 60 such that a sacrificial region 58F is defined between them. In this way, the full extension made possible by the extension cap 58 can be exploited, or the extension cap 58 can be broken away at the notches 60 such that once the sacrificial region 58F is removed, the now-free end region 58H can be moved adjacent proximal region 58J and attached to another base clip (not shown). It will be appreciated that the wall thickness of the aperture extension 50 and extension cap 58 are shown exaggerated for clarity, but that the actual dimensions are relatively thin, subject to minimum structural requirements, to keep weight and raw material cost low. Thus, no appreciable gaps are formed between the lower surface of the ribs 58D and the panel-forming surface (not presently shown), thus substantially preserving the desired panel shape along panel-facing surface 54A and upper surface 58A. Referring with particularity to FIG. 2C, a variation on the pattern formed in the panel by the aperture extension 50 is shown, where additional facets on the surface of recess portion 54 are included. An extension cap 58 is also included, where the interlocking connection between it and the aperture extension 50 is defined by complementary surfaces that are slidably engageable with one another along the longitudinal axis of the aperture extension 50, rather than through the toothed prismatic members previously shown. Referring with particularity to FIGS. 3A through 3C, intermediates 62 are shown. These devices are capable of fitting in between the aperture extension 50 and an extension cap 58, or can, if equipped with a chamfer 62D (as shown in FIG. 3B), act as a surrogate for the extension cap 58. Moreover, in situations where multiple apertures are formed into a single panel (such as that shown in FIG. 6), the intermediates 62 can act to bridge aperture extensions 50 or extension caps 58, thereby forming contiguous aperture extensions. As with the aperture extension 50 and the extension cap 58, the intermediate can include a base clip 56, either as a separate member (as shown in FIGS. 3A through 3C), or as an integral (unitary) part, as shown with particularity in FIG. 4. In the latter case, a notch 60 functions in a manner similar to that of the previous notches, allowing the clip to be broken away if not needed. In situations where a further extension is desired from the intermediate, the base clip 56 is left in place to allow an additional member to be attached thereto. The base clip 56 disposed at the distal end of recess portion 54 of aperture extension 50 is also configured to allow easy removal (if desired). As shown in FIG. 4, other pattern configurations along the recess portion 54 are possible. FIGS. 5A and 5B show how both the extension cap 58 and the intermediates 62 can be combined with the aperture extension 50. The intermediate in FIG. 5B shows, in a variation of the configurations of FIGS. 3A through 3C, an integrally-formed base clip 56 that does not have a breakaway feature built in. This can be used in situations where a robust intermediate is required.

Figure 7B:
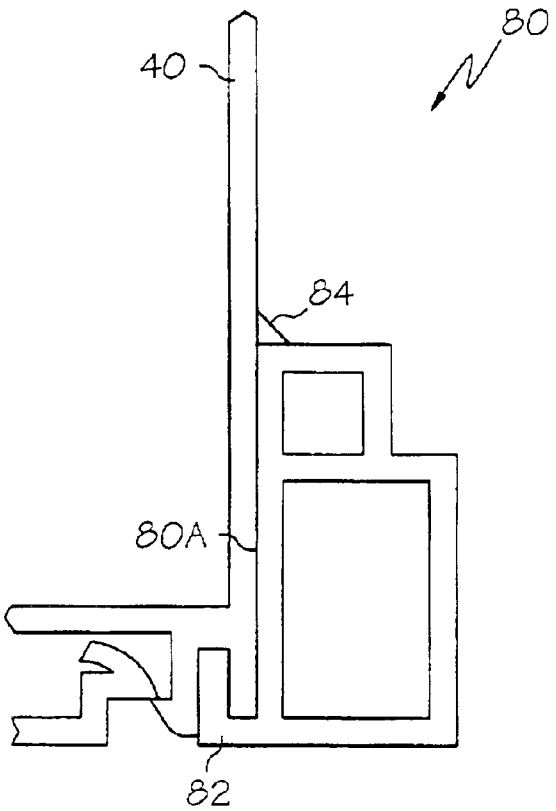
FIG. 7B shows a variation of the aperture extension of FIG. 7A.
Figure 7A:
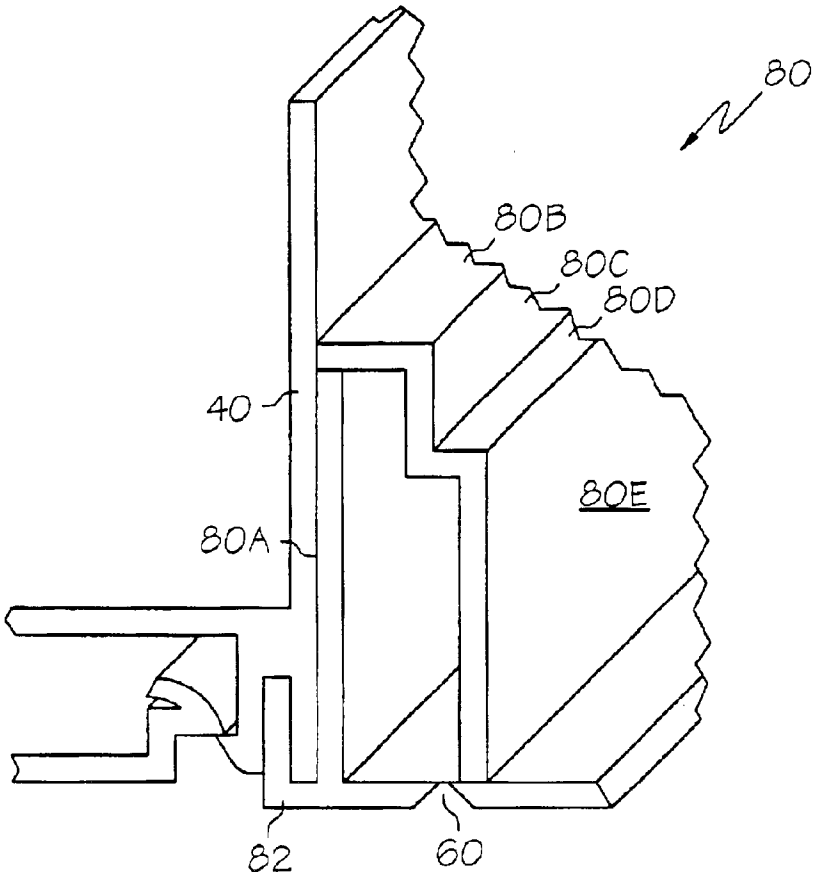
FIG. 7A shows an alternate embodiment of the aperture extension of FIG. 1A.

Referring next to FIGS. 7A and 7B, two variations on a multifaceted recess corner sealing device 80 are shown, where multifaceted recess corner sealing device 80 acts as a specific complement to aperture extension 50. The multifaceted recess corner sealing device 80, rather than emphasizing the low aspect ratio of the aperture extension 50, projects more in the heightwise dimension. The bulkhead-facing side of multifaceted recess corner sealing device 80 is defined by a substantially upstanding face 80A that forms a solid, generally planar surface. Individual faceted surfaces 80B, 80C, 80D and 80E are used to define the pattern formed in the panel upon the pouring and curing of the panel-forming material. Referring with particularity to FIG. 7A, the portion containing the various faceted surfaces can be removed along notches 60. As with the earlier drawings, the dimensions of the multifaceted recess corner sealing device 80 are not necessarily to scale, and while capable of occupying the substantial entirety of the height of the bulkhead 40, are typically relatively short in comparison. In the present figures, the bulkhead 40 is formed from a manufactured part (such as extruded plastic) that can include dimensions tailored to fit in addition to having a bulkhead-engaging portion 82. It will be appreciated by those skilled in the art that the bulkhead 40 can be either a conventional form (such as a piece of lumber) or the aforementioned manufactured part. FIG. 7B highlights the inclusion of an edge seal along the longitudinal dimension of the multifaceted recess corner sealing device 80. This seal, which can be made from a relatively soft, yet resilient, material, helps to prevent leakage of panel-forming material between the bulkhead 40 and the substantially upstanding face 80A.

Figure 8:
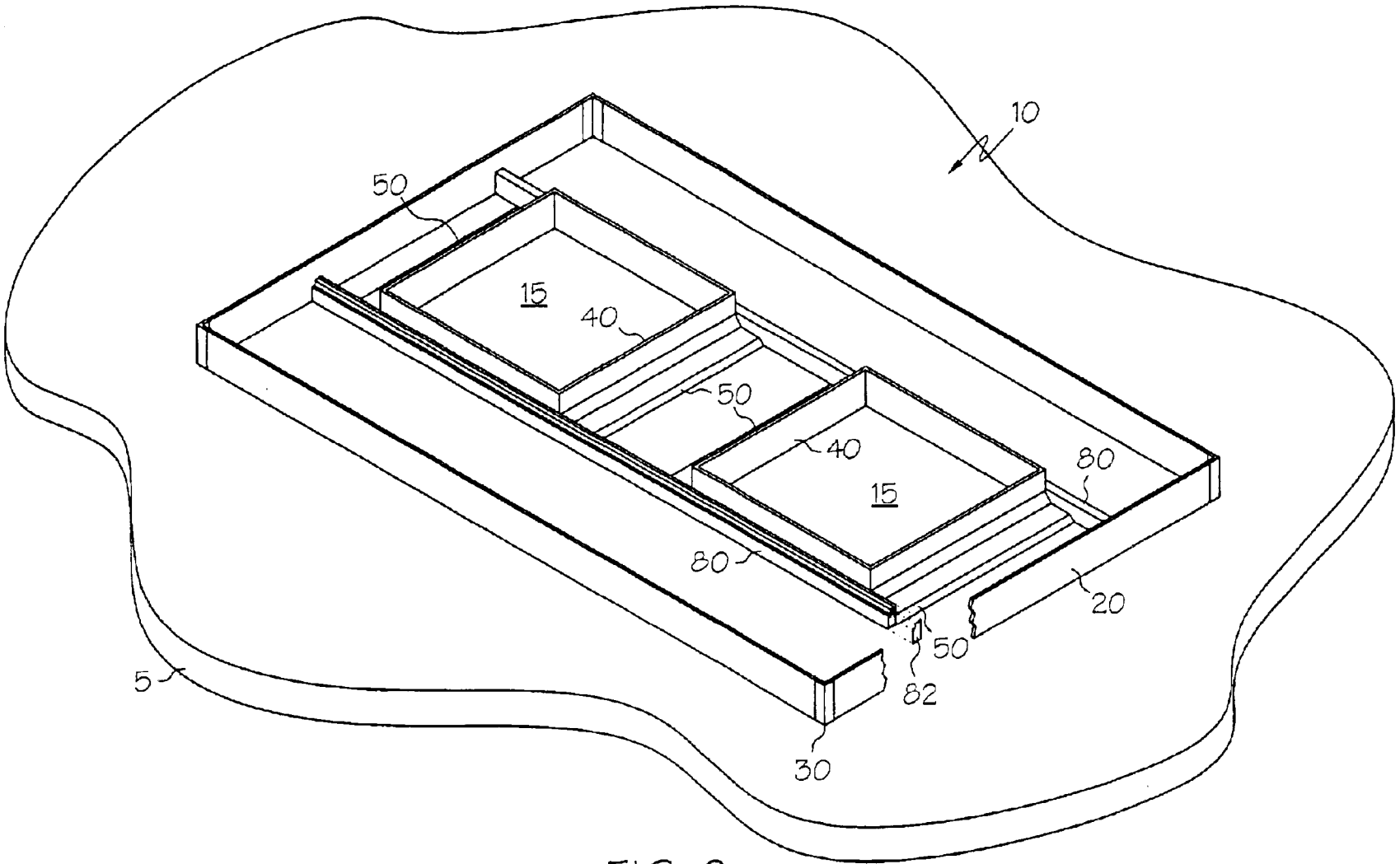
FIG. 8 shows a perspective view of an alternate panel-forming system according to the present invention.

Referring with particularity to FIG. 8, the use of the multifaceted recess corner sealing devices 80 in conjunction with the aperture extensions 50 are shown. Absent the presence of the substantially upstanding face 80A from the multifaceted recess corner sealing device 80, the ends of the aperture extensions 50 would be left exposed, thereby allowing uncured panel-forming material to seep in between the aperture extensions 50 and the panel-forming surface 5. The multifaceted recess corner sealing devices 80, which are shown extending along the entire lengthwise dimension of the panel-forming system 10, act to close of the exposed end of the aperture extensions 50 that extend the width of the aperture 15. As previously mentioned, the multifaceted recess corner sealing devices 80 need not extend all the way to the bulkheads 20 that define the ends of the panel-forming system 10. In such a configuration, end caps 82 could be fitted onto the ends of the multifaceted recess corner sealing devices 80 to inhibit the flow of panel-forming material into the device cavities. The figure also shows in the gap between the two aperture extensions 50 disposed between the two apertures 15 where one of the intermediates 62 (specifically, an extended version of the variant shown in FIG. 3A) could fit to form a bridge between the two apertures 15. By having the heightwise dimension of the multifaceted recess corner sealing device 80 be at least as tall as the highest exposed portion of the aperture extension 50, the present system reduces the likelihood that panel-forming material will leak underneath the aperture extension 50. As previously mentioned, the relative height of the aperture extension and the multifaceted recess corner sealing device 80 are shown somewhat enlarged for clarity.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A panel-forming system comprising:

a plurality of bulkheads configured to be placed on a panel-forming surface, said bulkheads comprising a first group and a second group, said first group arranged in the shape of a panel to be formed, said second group configured to be disposed substantially within a shape formed by said first group such that, upon formation of a panel with dimensions bounded by said first group and said second group, an aperture becomes defined in a space substantially surrounded by said second group; and at least one aperture extension comprising:

a bulkhead-engaging portion comprising:

a first chamfer disposed adjacent at least one of said plurality of bulkheads; and a second chamfer laterally spaced relative to said first chamfer; and a recess portion formed separately from said bulkhead-engaging portion, said recess portion configured to support at least a portion of said bulkhead-engaging portion such that upon formation of said panel, a pattern becomes defined therein by surfaces on at least said bulkhead-engaging portion.

2. A panel-forming system according to claim 1, wherein said first and second chamfers on said bulkhead-engaging portion are separated by a region substantially non-coplanar with either of said chamfers such that a surface in said panel formed by said bulkhead-engaging portion is multifaceted.

3. A panel-forming system according to claim 1, wherein said first and second chamfers define a succession of chamfers descending away from said at least one bulkhead.

4. A panel-forming system according to claim 3, wherein said bulkhead-engaging portion defines a surface disposed thereon that is situated between said first and second chamfers.

5. A panel-forming system according to claim 4, wherein said surface disposed between said first and second chamfers is coplanar with neither said first and second chamfers.

6. A panel-forming system according to claim 4, wherein said surface disposed between said first and second chamfers is a plateau.

7. A panel-forming system according to claim 1, wherein said bulkhead-engaging portion further comprises a stiffening rib configured to engage said recess portion.

8. A panel-forming system according to claim 1, wherein said recess portion extends laterally away from said bulkhead farther than does said bulkhead-engaging portion.

9. A panel-forming system according to claim 8, wherein said recess portion extends a substantial entirety of the distance between two of said plurality of bulkheads.

10. A panel-forming system according to claim 8, wherein said recess portion extends less than a substantial entirety of the distance between two of said plurality of bulkheads, said recess portion comprising a distal end situated away from said at least one bulkhead.

11. A panel-forming system according to claim 10, further comprising an extension cap configured to engage said distal end of said recess portion.

12. A panel-forming system according to claim 10, further comprising an intermediate configured to engage said distal end of said recess portion.

13. A panel-forming system according to claim 1, further comprising at least one stiffening rib disposed along said recess portion.

14. A panel-forming system according to claim 13, further comprising a base clip configured to frictionally engage said at least one stiffening rib.

15. A panel-forming system according to claim 14, wherein said at least one frictional engagement between said base clip and said at least one stiffening rib comprises a plurality of prismatic members disposed on coupling surfaces of said clip and said rib.

16. A panel-forming system according to claim 1, wherein said aperture is surrounded in its entirety by said second group such that a window is defined therebetween.

17. A panel-forming system according to claim 1, further comprising a seal disposed on at least one of said chamfers.

18. A panel-forming system according to claim 1, wherein said aperture is surrounded by both said first and second groups such that a door is defined therebetween.

19. A panel-forming system according to claim 1, wherein said second group is configured to define a plurality of apertures in said panel.

20. A panel-forming system according to claim 19, wherein said plurality of apertures in said panel are substantially aligned along at least one edge with one another.

* * * * *

UNITED STATES PATENT AND TRADEMARK OFFICE

CERTIFICATE OF CORRECTION

PATENT NO. : 6,883,772 B2
APPLICATION NO. : 10/454380
DATED : April 26, 2005
INVENTOR(S) : Takagi et al.

It is certified that error appears in the above-identified patent and that said Letters Patent is hereby corrected as shown below:

Title page,
Insert Item
-- Related U.S. Application Data
[63] Continuation-in-part of application No. 10/327,723, filed on December 23, 2002, which is now U.S. Patent No. 6,821,466, issued November 23, 2004, which claims the benefit of U.S. Provisional Application Serial No. 60/344,835, filed December 21, 2001. --.

Column 1,
Lines 6-7, reads as "This application is related to U.S. application Ser. No. 10/327,723, filed December 23, 2002" should read -- This application is a continuation-in-part of U.S. Application Serial No. 10/327,723, filed December 23, 2002, which claims the benefit of U.S. Provisional Application Serial No. 60/344,835, filed December 21, 2001. --.

Signed and Sealed this

Twenty-seventh Day of June, 2006

JON W. DUDAS
*Director of the United States Patent and Trademark Office*